US012638274B1

(12) United States Patent
Iliev et al.

(10) Patent No.: US 12,638,274 B1
(45) Date of Patent: May 26, 2026

(54) URBAN FOLDABLE SHIELD

(71) Applicant: ShotStop Ballistics LLC, Stow, OH (US)

(72) Inventors: Vall Iliev, Stow, OH (US); Martin Iliev, Stow, OH (US)

(73) Assignee: TAD Acquisition Company, LLC, Akron, OH (US)

( * ) Notice: Subject to any disclaimer, the term of this patent is extended or adjusted under 35 U.S.C. 154(b) by 1230 days.

(21) Appl. No.: 17/516,758

(22) Filed: Nov. 2, 2021

Related U.S. Application Data

(63) Continuation-in-part of application No. 17/467,189, filed on Sep. 4, 2021, now abandoned, which is a continuation-in-part of application No. 17/328,521, filed on May 24, 2021, now abandoned, which is a continuation-in-part of application No. 16/819,045, filed on Mar. 14, 2020, now abandoned, which is a continuation-in-part of application No. 16/752,683, filed on Jan. 26, 2020, now abandoned, and a continuation-in-part of application No. 15/942,535, filed on Apr. 1, 2018, now abandoned, which is a continuation-in-part of application No. 15/942,533, filed on Apr. 1, 2018, now abandoned, and a continuation-in-part of application No. 15/335,196, filed on Oct. 26, 2016, now Pat. No. 10,048,046, and a continuation-in-part of application No. 15/335,219, filed on Oct. 26, 2016, now Pat. No. 10,445,263, said application No. 15/335,196 is a continuation-in-part (Continued)

(51) Int. Cl.
*F41H 5/08* (2006.01)
*F41H 5/013* (2006.01)

(52) U.S. Cl.
CPC ..... *F41H 5/08* (2013.01); *F41H 5/013* (2013.01)

(58) Field of Classification Search
CPC ..... F41H 5/08; F41H 5/013
See application file for complete search history.

(56) References Cited

U.S. PATENT DOCUMENTS 778,070 A 12/1904 Pitt
2,582,373 A * 1/1952 Cordrey ..... F24C 15/12 126/299 C (Continued)

FOREIGN PATENT DOCUMENTS

WO WO2015138025 A1 9/2015

*Primary Examiner* — Lawrence D Ferguson
(74) *Attorney, Agent, or Firm* — Gugliotta & Gugliotta LPA

(57) ABSTRACT

A ballistic shield device is formed of a segmented body having an upper panel, a center panel and a lower panel. Each panel has a substantially planar front and rear surfaces and form a generally rectangular perimeter. A flexible hinge provides a folding connection between the upper panel and the center panel. A second hinge provides a similar folding connection between the center panel and the lower panel. A handle and forearm strap may be connected to the rear surface of the upper panel and extending rearwardly therefrom. A hook and loop fastener or other functionally equivalent attachment mechanism may be affixed about an upper edge of the upper panel. Each panel may be formed of a PE/HDPE material encased in a textile carrier, formed in a manner such as to circumscribe the entire ballistic material panels.

14 Claims, 4 Drawing Sheets

Related U.S. Application Data of application No. 14/701,326, filed on Apr. 30, 2015, now Pat. No. 9,944,041, which is a continuation-in-part of application No. 13/219,920, filed on Aug. 29, 2011, now Pat. No. 9,180,623.

(60) Provisional application No. 63/111,110, filed on Nov. 9, 2020, provisional application No. 62/837,441, filed on Apr. 23, 2019.

(56) References Cited

U.S. PATENT DOCUMENTS

| | | | | |
|---|---|---|---|---|
| 3,968,546 | A | 7/1976 | Seaborn et al. | |
| 4,412,495 | A * | 11/1983 | Sankar | F41H 5/08 2/2.5 |
| 4,566,237 | A | 1/1986 | Turner | |
| 5,257,583 | A | 11/1993 | Koenig | |
| 5,683,781 | A | 11/1997 | Komarek et al. | |
| 5,907,930 | A | 6/1999 | Ricco, Sr. | |
| 6,007,469 | A | 12/1999 | Jaegers et al. | |
| 7,415,806 | B2 | 8/2008 | Davidson | |
| 7,661,228 | B1 | 2/2010 | Nolte et al. | |
| 7,784,232 | B2 | 8/2010 | Nygren et al. | |
| 7,921,758 | B2 | 4/2011 | Eden et al. | |
| 8,544,240 | B2 | 10/2013 | Hughes, Jr. | |
| 9,115,960 | B2 | 8/2015 | Kim | |
| 9,180,623 | B1 | 11/2015 | Iliev | |
| 9,944,041 | B1 | 4/2018 | Iliev | |
| 10,048,046 | B1 | 8/2018 | Iliev | |
| 10,082,372 | B1 | 9/2018 | Iliev | |
| 2003/0159400 | A1 | 8/2003 | Forrester | |
| 2004/0173201 | A1 * | 9/2004 | Haemerle | F24C 15/12 126/299 C |
| 2005/0086905 | A1 | 4/2005 | Ralph et al. | |
| 2006/0248827 | A1 | 11/2006 | Meeker | |
| 2007/0224401 | A1 | 9/2007 | Telander | |

* cited by examiner

URBAN FOLDABLE SHIELD

BACKGROUND OF THE INVENTION

1. Field of the Invention

This invention relates to ballistic shields and, more particularly, to a hand-held and foldably adjustable ballistic shield for protecting a law enforcement officer from gunfire or other threats.

2. Description of the Related Art

Portable shields, ballistic shields or tactical shields are protection devices deployed by law enforcement, military, security, and other personnel. Designed to stop or deflect bullets fired at their carrier, such shields will also protect from other less fatal threats such as thrown items. These are also distinguished from riot shields, which are lightweight protection devices deployed against protestors. Riot shields are typically long enough to cover an average-sized person from the top of the head to the knees, though smaller one-handed models may also be used. They are generally intended to be used in riot control, to protect the user from melee attacks with blunt or edged weapons and also thrown projectiles, or non-lethal weapons such as rubber bullets and water cannons. They can also be used as short-ranged melee weapons to push back the opposing force.

Riot shields do not generally nor necessarily offer ballistic protection and are deployed when armed conflict is not anticipated. Ballistic shields, however, are used in situations where armed resistance is expected.

Existing ballistic shields vary in size between protecting only the upper torso or protecting the whole body, with other "personal shields" being small enough to be carried by a single person or carried in police.

While various sizes and features provide for various use-case functionality, many law enforcement organizations are not able to procure separate system for riot protection, ballistic protection, personal protection or other scenarios due to limitations on budget, training, and other resources. Consequently, a need exists for an adjustable and adaptable ballistic shield for protecting a law enforcement officer from gunfire or other threats from in a variety of differing circumstances.

SUMMARY OF THE INVENTION

Primary objects of the present invention include providing a system for and a method of ballistic protection that can be adapted to a variety of circumstances or scenarios.

It is a feature of the present invention to provide a portable ballistic resistant shielding that can be adaptable to expand in order to accommodate various personnel protection needs.

The present invention provides a ballistic shield device formed of a segmented body having an upper panel, a center panel and a lower panel. Each panel has a substantially planar front and rear surfaces and forms a generally rectangular perimeter. The upper panel has an over rectangular configuration of about 18 inches wide and about 17 inches tall. The center panel has an over rectangular configuration of about 18 inches wide and about 15 inches tall. A first horizontal hinge provides a folding connection between the upper panel and the center panel. The lower panel has an over rectangular configuration of about 18 inches wide and about 14 inches tall. A second horizontal hinge provides a similar folding connection between the center panel and the lower panel. A handle and forearm strap may be connected to the rear surface of the upper panel and extend rearwardly therefrom. Furthermore, a hook and loop fastener or other functionally equivalent attachment mechanism may be affixed about an upper edge of the upper panel. Each panel may be formed of a PE/HDPE material encased in a textile carrier, formed in a manner such as to circumscribe the entire ballistic material panels.

An advantage of the present ballistic shield provides an adjustable and adaptable protection device for protecting a law enforcement officer from gunfire or other threats from a variety of differing circumstances.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

The best mode for carrying out the invention is presented in terms of its preferred embodiment, herein depicted within the Figures.

1. Detailed Description of the Figures

Figure 3:
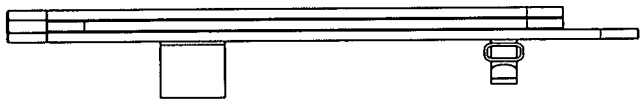
FIG. 3 is a right side elevational view thereof shown in a folded, compact configuration.
Figure 2:
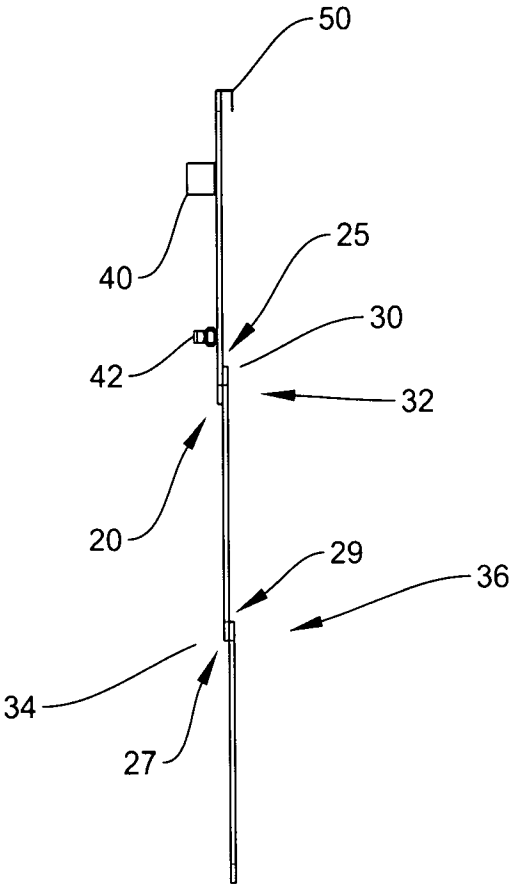
FIG. 2 is a right side elevational view thereof.
Figure 1:
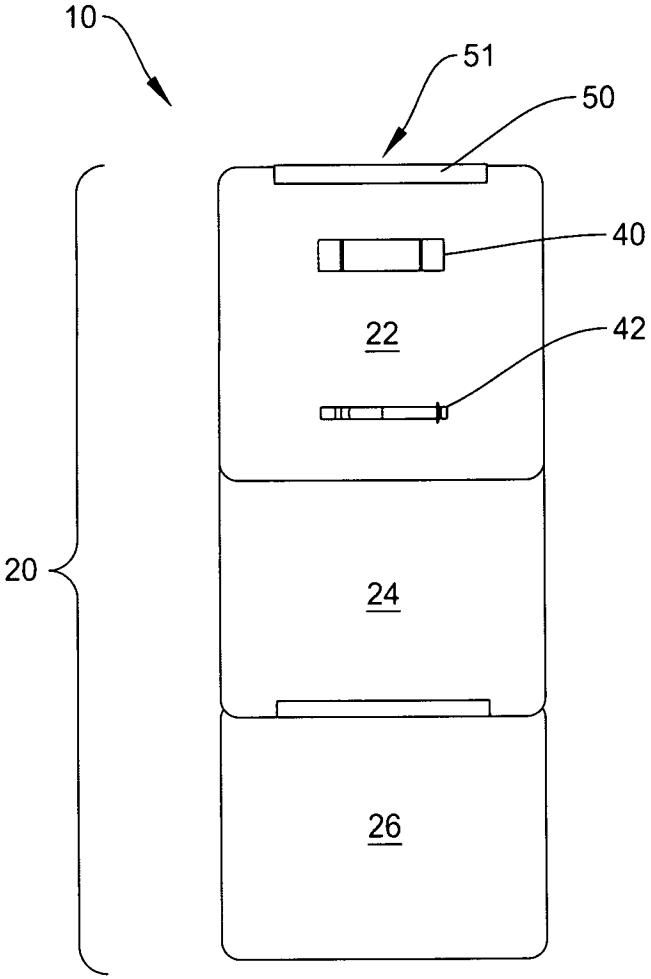
FIG. 1 is a front elevational view showing a foldably adjustable ballistic shield according to the preferred embodiment.
Figure 6:
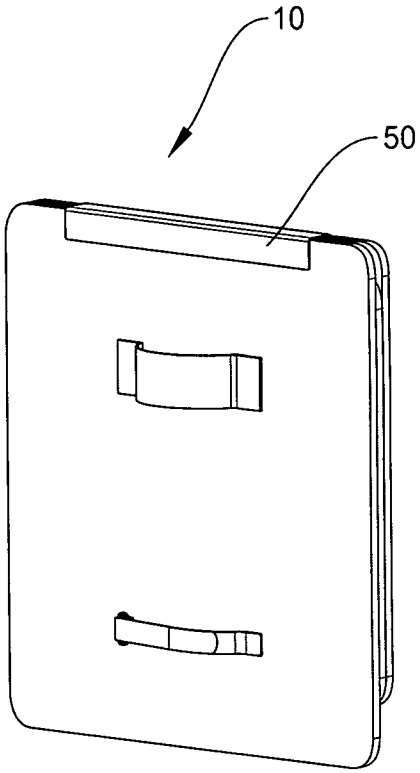
FIG. 6 is a right rear perspective view of the folded, compact configuration of FIG. 3.
Figure 5:
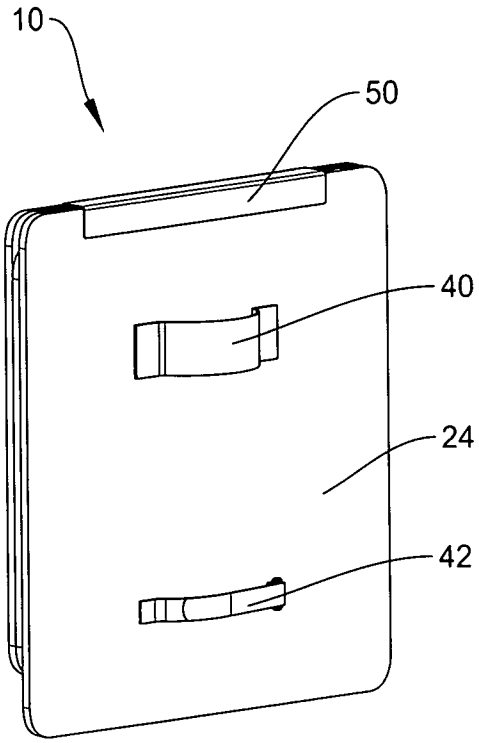
FIG. 5 is a left rear perspective view of the folded, compact configuration of FIG. 3.
Figure 4:
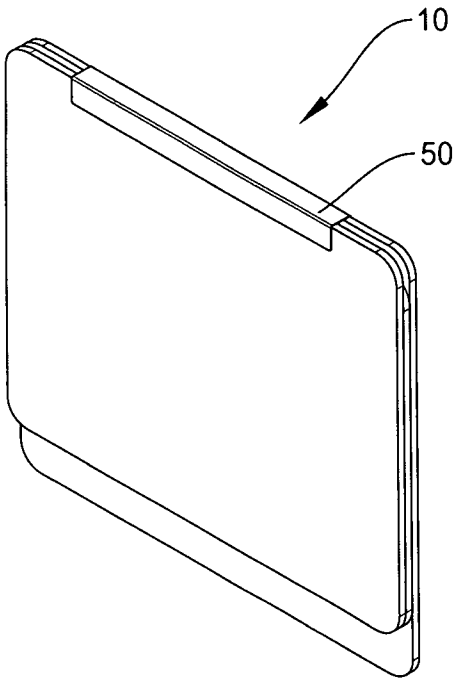
FIG. 4 is a rear perspective view of the folded, compact configuration of FIG. 3.

Referring now to FIG. 1 through FIG. 6, wherein like reference numerals indicate the same parts throughout the several views, a ballistic shield device 10 is shown according to the preferred embodiment of the present invention. The shield 10 is formed of a segmented body 20 having an upper panel 22, a center panel 24 and a lower panel 26. As provided for the intended uses, as described in greater detail below, the three-plate configuration is greatly preferred. However, it should be apparent to one having ordinary skill in the relevant art, in view of the present invention, that an alternate configuration utilizing only two (2) such shield plates may also be provided within the present intended scope.

Each panel 22/24/26 has substantially planar front and rear surfaces and form a generally rectangular perimeter. The upper panel 22 has an over rectangular configuration of about 18 inches wide and about 17 inches tall. The center panel 24 has an over rectangular configuration of about 18 inches wide and about 15 inches tall. A first horizontal hinge 30 provides a folding connection between a lower side 23 of the upper panel 22 and an upper side 25 of the center panel 24 in a manner forming first offset 32 of approximately 2 inches.

The lower panel 26 has an over rectangular configuration of about 18 inches wide and about 14 inches tall. A second horizontal hinge 34 provides a similar folding connection between a lower side 27 of the center panel 24 and an upper side 29 of the lower panel 26 in a manner forming a second offset 36 of approximately 1 inch.

The present invention further includes a handle 40 connected to the rear surface of the upper panel 22 and extending rearwardly therefrom. The handle 40 is selectively engageable by an operator for supporting the shield 10. A forearm strap 42 may be connected to the rear surface of the upper panel 22 and extending rearwardly therefrom. Furthermore, a hook and loop fastener 50 or other functionally equivalent attachment mechanism may be affixed about an upper edge 51 of the upper panel 22.

Each panel 22/24/26 preferably is formed of a ballistic barrier system providing low weight, high energy absorbing structures for ballistic protection against projectiles from munitions and/or shrapnel. Each protection panel 22/24/26 may form any level of NIJ protection, including but not limited to NIJ Level Ill or NIJ Level IIIA and that is capable of providing protection at least including level IIIA, National Institute of Justice, N12 standard 0108.01. In an exemplary aspect of the present invention, an otherwise amorphous plastic such as high density polyethylene ("HDPE") having an unaligned, non-crystalline molecular structure is modified such as to result in a planar sheet material having a targeted molecular alignment. By mechanically modifying the HDPE, the alignment of the fibers creates an anisotropic material that can be further utilized as molecularly oriented thin planar sheets that are also structurally rigid as well as buoyant in the event it contacts the water. The ballistic resistant panels may be formed of such materials may be of an overall planar area silhouetting the key functional elements of the shield assembly 10. It has been found that by modifying the thickness of the panels a sufficient and desired level of ballistic resistance may be achieved.

Each ballistic shield 20 may further include variations of textured planar material or flat planar material formed of strand or ribbon oriented strips polyethylene as more fully shown, taught and described in U.S. Pat. No. 9,180,623, incorporated by reference as if rewritten herein in its entirety. As shown generally in the related art, the use of PE or HDPE in the production of composite materials capable of being used to create anti-ballistic devices is taught through the use of blending with carbon nanotube or other additives, orienting the materials into aligned strips to create oriented plies of materials, and then layering numerous plies at a bias to one another while building a desired thickness of material.

Similar to any plastics, PE/HDPE is an amorphous plastic having a nebulous, fluid-like non-crystalline molecular structure. Since PE is an amorphous material, it does not have a yield failure point like crystalline materials. As such, PE/HDPE is an elastic material that remains elastic throughout its elongation all the way up to the break point. Since it is an amorphous material, it is not subject to environmental stress cracking nor stress cracks when exposed to multi-axial stresses. However, PE, HDPE or equivalent materials themselves are generally hard and rigid and lacks good elongation properties necessary for use as ballistic materials. In order to improve this characteristic and make the resultant product soft and pliable, mechanical modification of the orientation of the non-crystalline molecular structure is provided.

According to an alternate aspect of the present invention, teach each ballistic shield 20 may further comprise modularly incremental ballistic resistant armor insert as more fully shown, taught and described in U.S. patent application Ser. No. 15/942,535, incorporated by reference as if rewritten herein in its entirety, in which a plurality of armor subplates are provided that can be nested in an aligned manner. Each subplate is further formed of aligned and oriented ballistic material formed of an improved composite ballistic material which includes high strength fibers made from materials such as extended chain ultra-high molecular weight polyethylene. By aligning and nesting a plurality of subplates, a user can create varying degrees of resistance to penetration by high speed impact from projectiles such as bullets, shells, shrapnel and the like in accordance with a desired threat level. Inserting one such subplate will give the end user multi-shot protection at Level IIIA for a handgun up to .44 MAG per NIJ 0101.06. Inserting two such subplates will give the end user multi-shot protection at Level Ill for rifle guns up to AR15 and AK47 per NIJ 0101.06. Inserting three such subplates will give the end user multi-shot protection at Level IV for armor piercing guns like 30.06 M2 AP FMJ per NIJ 0101.06.

Each plastic ballistic material may be further encased in a textile carrier, formed in a manner such as to circumscribe the entire ballistic material panels. According to one aspect of the present invention the carrier may be permanently affixed about each panel. According to an alternate aspect of the present invention, the carrier may further provide access such that each panel 22/24/26 may be inserted or removed for selective replacement as necessary.

2. Operation of the Preferred Embodiment

In such a configuration, the three shield panels 22/24/26 may be foldably deployed to a greater overall length. As indicated above, a preferred configuration is provided having an over rectangular configuration of about 18 inches wide and about 43 inches tall when deployed. When carried or stored, the shield 10 may be folded at the hinged connection between panels. In such a configuration, when in a closed condition, as best shown in conjunction with FIG. 4 through FIG. 6, the center panel 24 may be folded upward and the lower panel 26 may be folded downward such as to form a minimized nesting in a manner that still allows the overall assembly 10 to remain supported by the handle 40 and forearm strap 42.

Figure 10:
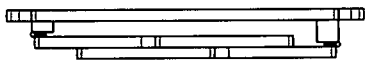
FIG. 10 is a top plan view thereof.
Figure 9:
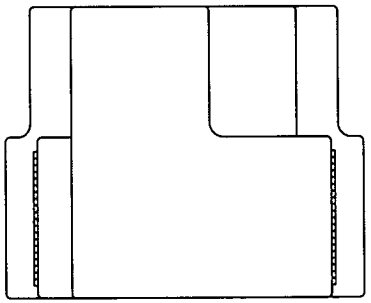
FIG. 9 is a front elevational view thereof shown in a folded, compact configuration.
Figure 8:
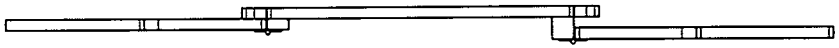
FIG. 8 is a top plan view thereof.
Figure 7:
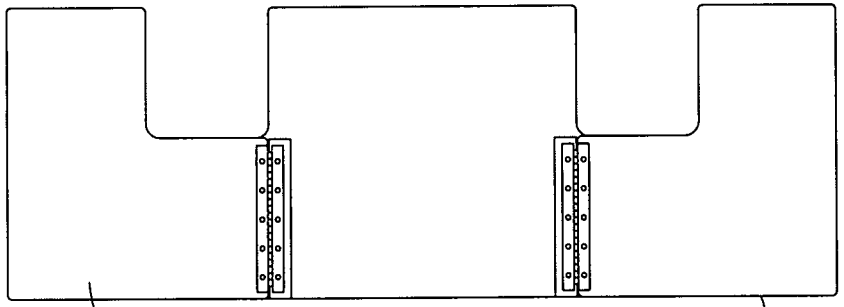
FIG. 7 is a front plan view showing a foldably adjustable ballistic shield according to a first alternate configuration of the preferred embodiment.
Figure 12:
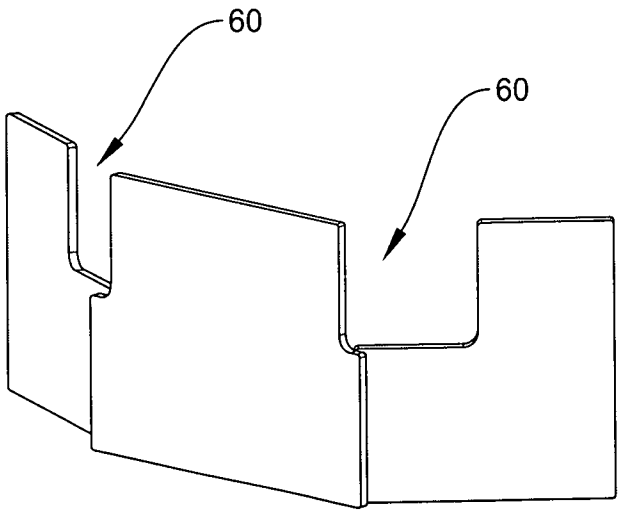
FIG. 12 is a rear perspective view thereof.
Figure 11:
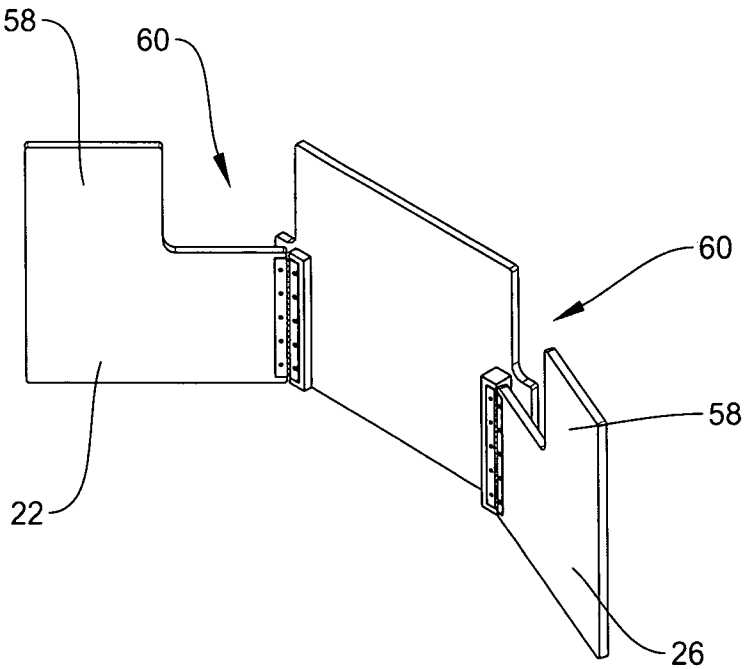
FIG. 11 is a front perspective view thereof.

It should be apparent that the features and function of the present invention as shown may be included in alternate configurations while still being within the same overall scope. By way of example, and not meant as a limitation, as shown in FIG. 7 through FIG. 12 depict a foldably adjustable ballistic shield according to a first alternate configuration of the preferred embodiment in which a generally horizontal deployment is envisioned. In such a configuration, the upper panel 22 and lower panel 26 may further be formed in a generally "L" shape forming an upward merlon 58 such as to form a crenel 60 between panels 22/24 and 24/26, respectively.

In operation, any configuration of the present invention may by used to provide ballistic protection in a variety of law enforcement scenarios.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application.

What is claimed is:

1. A ballistic shield comprising:

a segmented body having an upper panel, a center panel hingedly affixed to a lower edge the upper panel, and a lower panel hingedly affixed to a lower edge of the center panel-having a planar front and rear surfaces and form a rectangular perimeter;

wherein the upper panel, center panel, and lower panel are each formed of PE/HDPE ballistic material encased in a textile carrier;

a handle connected to the rear surface of the upper panel extending rearwardly therefrom; and a forearm strap connected to the rear surface of the upper panel extending rearwardly therefrom;

wherein the ballistic shield is configured for protecting a law enforcement officer from gunfire.

2. The ballistic shield of claim 1, further comprising:

the upper panel having an over rectangular configuration of about 18 inches wide and about 17 inches tall;

the center panel having an over rectangular configuration of about 18 inches wide and about 15 inches tall;

the lower panel has an over rectangular configuration of about 18 inches wide and about 14 inches tall.

3. The ballistic shield of claim 2, wherein each panel is formed of a PE/HDPE material encased in a textile carrier.

4. The ballistic shield of claim 1, further comprising a handle and forearm strap may be connected to the rear surface of the upper panel and extending rearwardly therefrom.

5. The ballistic shield of claim 2, further comprising a handle and forearm strap may be connected to the rear surface of the upper panel and extending rearwardly therefrom.

6. The ballistic shield of claim 3, further comprising a handle and forearm strap may be connected to the rear surface of the upper panel and extending rearwardly therefrom.

7. The ballistic shield of claim 1, further comprising a hook and loop fastener or other functionally equivalent attachment mechanism may be affixed about an upper edge of the upper panel.

8. The ballistic shield of claim 2, further comprising a hook and loop fastener or other functionally equivalent attachment mechanism may be affixed about an upper edge of the upper panel.

9. The ballistic shield of claim 3, further comprising a hook and loop fastener or other functionally equivalent attachment mechanism may be affixed about an upper edge of the upper panel.

10. The ballistic shield of claim 4, further comprising a hook and loop fastener or other functionally equivalent attachment mechanism may be affixed about an upper edge of the upper panel.

11. The ballistic shield of claim 5, further comprising a hook and loop fastener or other functionally equivalent attachment mechanism may be affixed about an upper edge of the upper panel.

12. The ballistic shield of claim 3, wherein each said panel comprises one insert providing multi-shot protection at Level IIIA for a hand gun up to .44 MAG per NIJ 0101.06.

13. The ballistic shield of claim 3, wherein each panel comprises two inserts providing multi-shot protection at Level III for rifle guns up to AR15 and AK47 per NIJ 0101.06.

14. The ballistic shield of claim 3, wherein each panel comprises three inserts providing multi-shot protection at Level IV for armor piercing guns like 30.06 M2 AP FMJ per NIJ 0101.06.

* * * * *